US005406670A

United States Patent [19]

Juratovac et al.

[11] Patent Number: 5,406,670

[45] Date of Patent: Apr. 18, 1995

[54] DUST MOP

[75] Inventors: Diana W. Juratovac; Rainer B. Teufel; Thomas J. Ward, all of Columbus, Ohio; Mary R. Holt, West Harrison, Ind.

[73] Assignee: Vining Industries, Inc., Springfield, Ohio

[21] Appl. No.: 94,832

[22] Filed: Jul. 20, 1993

[51] Int. Cl.[6] ..... A47L 13/24

[52] U.S. Cl. ..... 15/229.2; 15/147.2; 15/229.6

[58] Field of Search ..... 15/147.2, 229.1–229.9, 15/118

[56] References Cited

U.S. PATENT DOCUMENTS

| | | | |
|---|---|---|---|
| 932,070 | 8/1909 | Tribble | 15/229.2 |
| 1,117,209 | 11/1914 | Massey | 15/229.2 |
| 1,298,039 | 3/1919 | Gooldy | 15/229.7 |
| 1,420,180 | 6/1922 | Casmire | 15/229.4 |
| 1,577,774 | 3/1926 | Tarbox | 15/229.4 |
| 1,969,800 | 8/1934 | Kellogg | 15/229.2 |
| 2,646,588 | 7/1953 | Wagner | 15/147.2 |
| 2,727,268 | 12/1955 | Hulke | 15/229.8 |
| 2,929,087 | 3/1960 | Salmon | 15/229.8 |
| 4,245,368 | 1/1981 | Cotey et al. | 15/229.1 |
| 4,691,404 | 8/1991 | Tarrson et al. | 15/172 |
| 4,794,663 | 1/1989 | Vosbikian | 15/229.6 |
| 5,040,260 | 8/1991 | Michaels | 15/188 |

*Primary Examiner*—Mark Spisich

*Attorney, Agent, or Firm*—Panitch Schwarze Jacobs & Nadel

[57] ABSTRACT

A dust mop having a frame handle and mop yarn attached to at least one side of the frame. The frame having an integral handle socket attached to the frame by the tongue. The tongue is sufficiently flexible to flex under user pressure to keep the mop yarn in contact with the surface to be dusted and to remain substantially in a horizontal position when raised above the floor.

5 Claims, 4 Drawing Sheets

DUST MOP

TECHNICAL FIELD

This invention relates to mops used for dusting and light-duty cleaning. More particularly, this invention relates to mops used for dusting which can be used to easily clean a number of surfaces, including floors, ceilings and walls.

BACKGROUND

Mops used for dusting, also known as dust mops, have been in use for a substantial period of time. Typically these mops include a handle, a frame and yarn which extends over the frame. Typically the frame and handle are connected together by some form of hinging mechanism.

U.S. Pat. No. 4,392,269 discloses a mop carrier with a handle and a frame, the frame having an integral hinging means 9. This mop, however, is capable only of dusting using only one surface and cannot be used on two sides, as the preferred mops of the present invention.

U.S. Pat. No. 4,414,223 describes a dust mop having a removable cover. This mop is capable of hinging so that both sides of the mop can be used, however, this patent shows a pin hinge type of connection means, which makes it difficult to apply pressure to various surfaces.

U.S. Pat. No. 5,088,148 discloses a cleaning mop having a cylindrical attaching means for attaching a wiping cloth and other similar device. Again, this patent does not disclose a mop which can be used on a wide variety of surfaces and still maintain pressure against the surface to be cleaned.

SUMMARY OF THE INVENTION

This invention comprises a dust mop having a frame and handle; the frame having means for attaching mop yarn to at least one side of the frame; the frame further having a handle socket integrally attached to the frame by a tongue; the tongue being of a length and thickness to enable the tongue to flex under pressure applied by the user to keep the mop yarn in contact with a surface to be dusted and to remain substantially in a horizontal position when raised above the floor.

DESCRIPTION OF PREFERRED EMBODIMENTS

Figure 1:
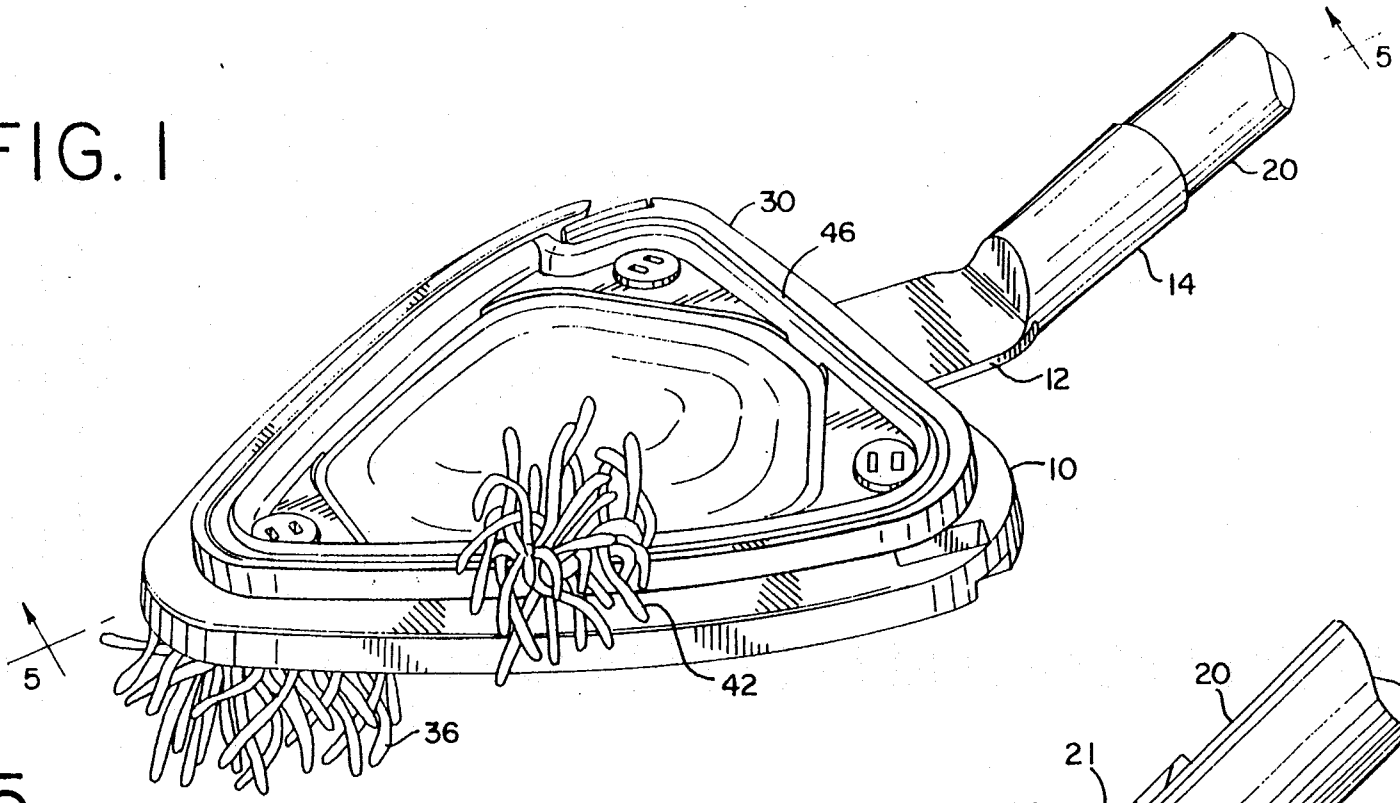
FIG. 1 is a three-quarter perspective view of the dust mop of the present invention.
Figure 5:
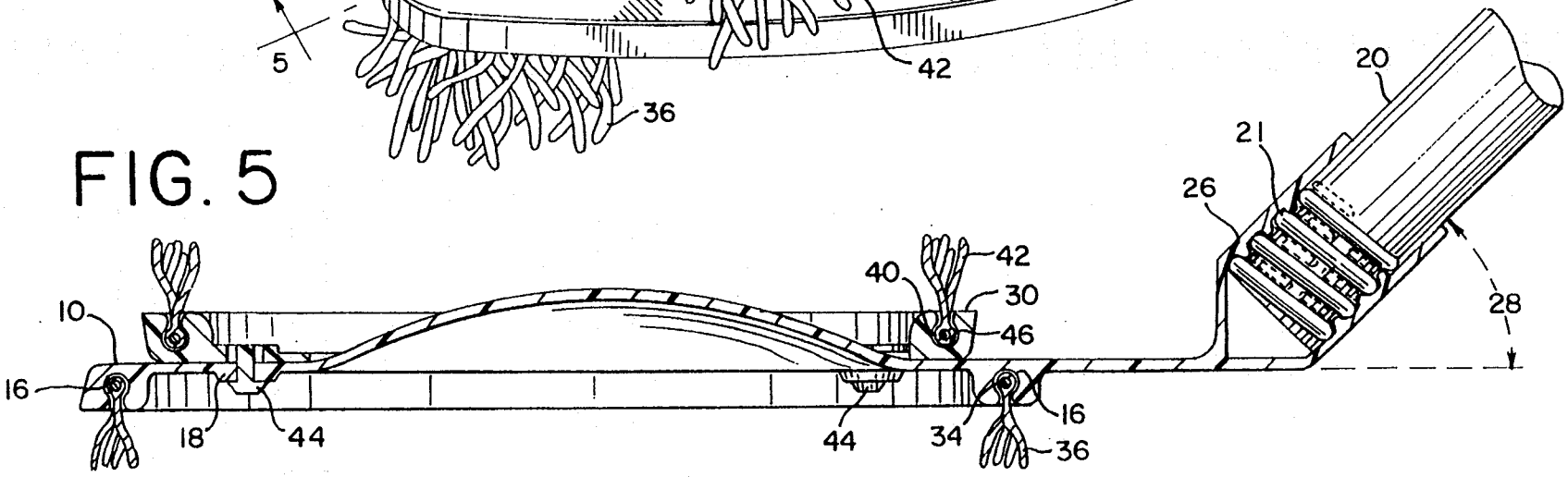
FIG. 5 is a sectional view taken along line 5—5 in FIG. 1.
Figure 2:
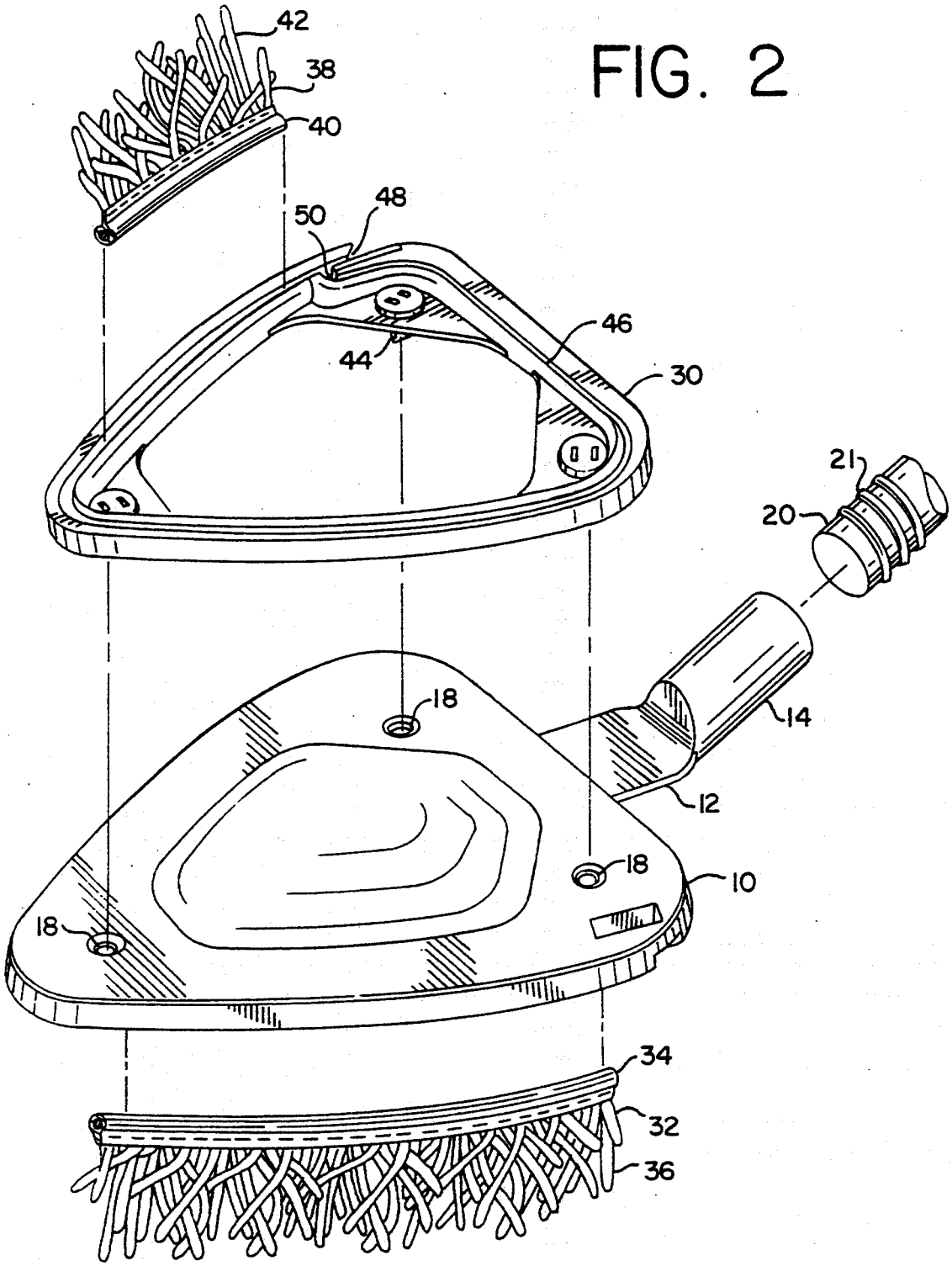
FIG. 2 is a three-quarter front exploded perspective view of the dust mop of the present invention.
Figure 3:
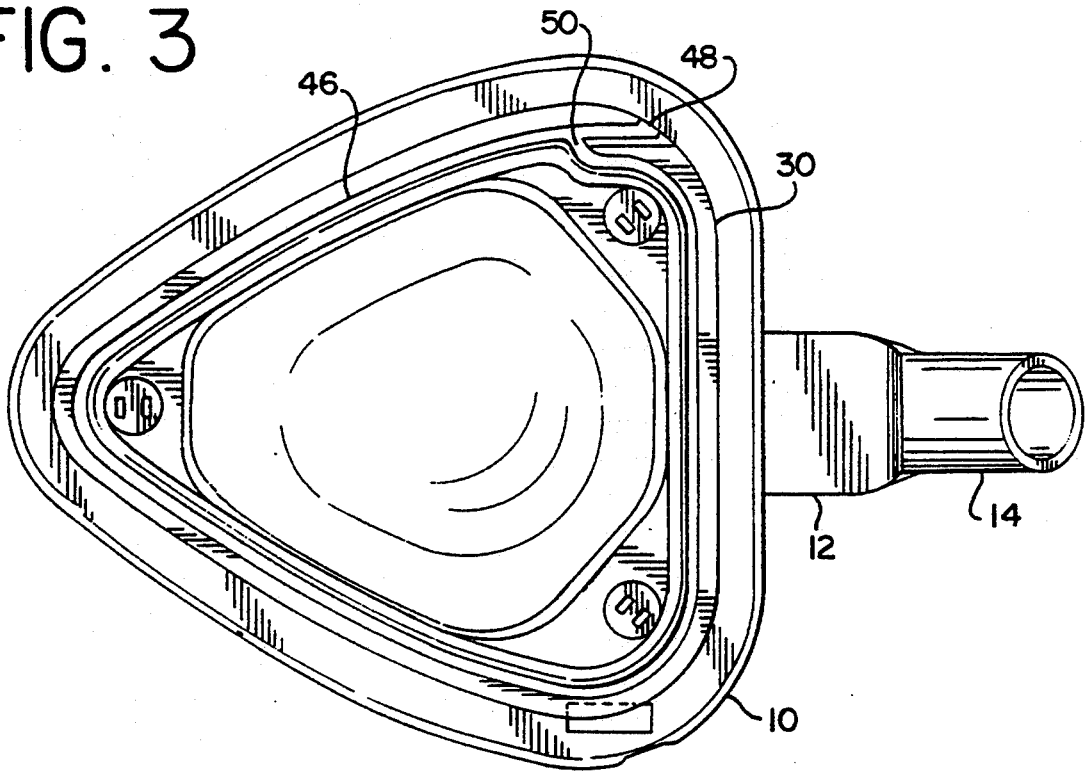
FIG. 3 is a top view of the dust mop frame of the present invention without yarn attached.
Figure 4:
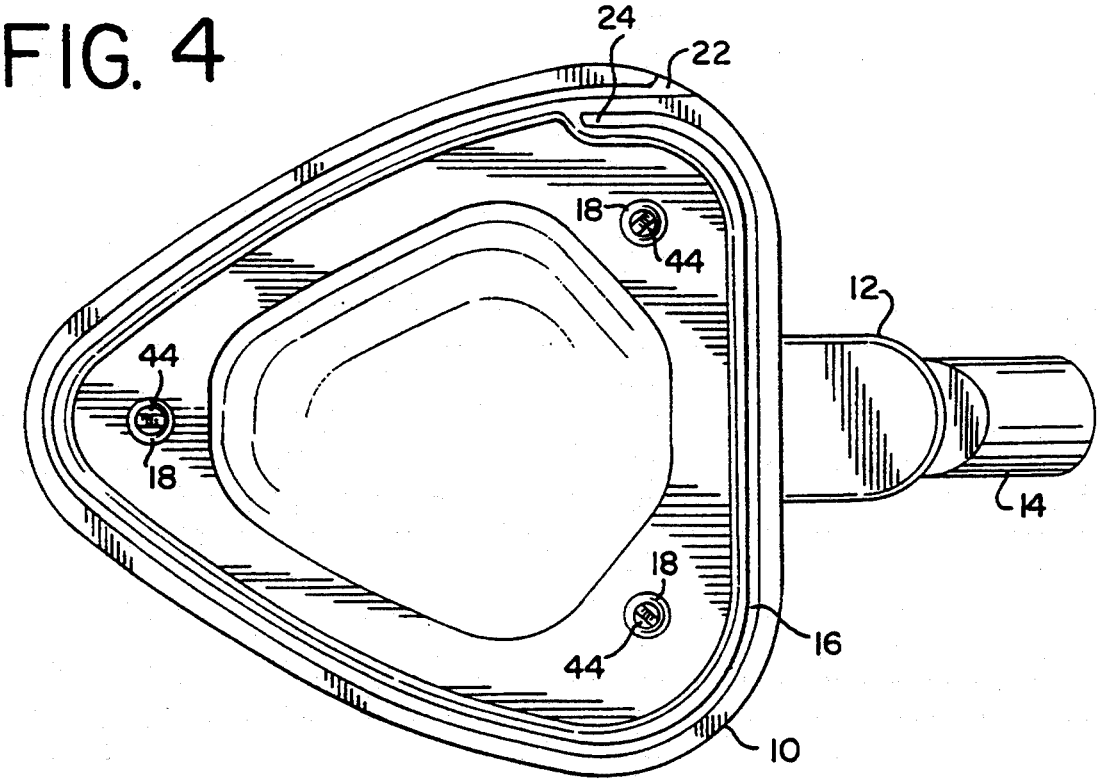
FIG. 4 is a bottom view of the frame without yarn attached.

As shown in FIGS. 1–5, the dust mop of the present invention includes a main frame 10, an upper frame 30, lower and upper mop yarn assemblies 32 and 38, a tongue 12, which is integral with main frame 10, and a handle socket 14, which is integral with tongue 12.

Main frame 10 also includes a lower welt channel 16 on the bottom side of main frame 10 and upper frame attachment holes 18. A handle 20 is attached to the mop by handle socket 14. Handle 20 can be any conventional handle, including handles having extension means, not shown. The handle is attached to the handle socket by means of threads on the handle 21, which mate with handle socket threads 26.

The lower and upper yarn assemblies 32 and 38 comprise mop yarn strands 36 and 42 attached to welts 34 and 40 respectively, by sewing or other conventional means. The mop yarn assembly 32 is attached to main frame 10 by placing welt 34 in lower welt channel 16, beginning at lower welt channel start 22 and extending around the periphery of main frame 10 in lower welt channel 16 to the lower welt channel finish 24.

Upper frame 30 includes an upper welt channel 46, upper frame connectors 44 in the same number as upper frame attachment holes 18 and placed in an arrangement to match exactly with upper frame attachment holes 18. Upper mop yarn assembly 38 is placed in upper welt channel 46, beginning at upper welt channel start point 48 and extending around the periphery of upper welt channel 46 to the upper welt channel finish point 50.

The weight of the yarn assemblies 32 and 38 combined are not particularly critical. However, the weight of the yarn should not be so great as to unduly stress tongue 12 or to tire the user. It is preferred to have a combined weight from 4 to 9 oz.

Upper frame 30 and main frame 10 are connected using the upper frame connectors 44 which are of a conventional construction such that when forced into upper frame attachment holes 18, a firm bond is achieved. Any conventional construction of the upper frame attachment connectors can be used including a bayonet type construction with barbs, prongs or other conventional connection means.

Figure 6:
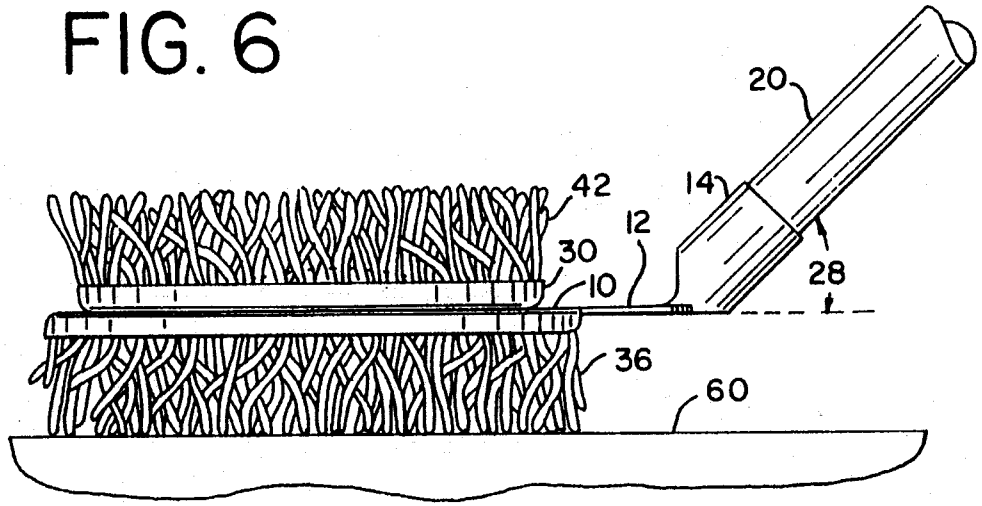
FIG. 6 is a diagrammatic side view of the dust mop in the floor-dusting position.

Main frame 10 is attached to handle socket 14 by means of tongue 12. Tongue 12 is essentially parallel with the main surface of main frame 10 and forms an angle 28 with handle socket 14. This handle tongue angle 28 is preferably within the range from 35° to 60° at rest. This provides sufficient tension to enable the user to use the dust mop such that lower mop yarn strands 36 are in contact with the floor surface 60 to be cleaned as shown diagrammatically in FIG. 6 and such that the upper surface of the mop is in a horizontal position when lifted above the floor to dust ledges, fan blades, etc.

The main frame 10, tongue 12 and handle socket 14 are preferably made from a material which, while maintaining a certain level of rigidity, it is sufficiently flexible such that tongue 12 will flex when pressure is applied to the mop but sufficiently rigid such that the mop will remain in a horizontal position when raised off the floor. The material used to fabricate main frame 10, tongue 12 and handle socket 14 should be as noted sufficiently tough to maintain dimensional stability, yet flexible enough so that tongue 12 will flex in use, but also such that it will not fatigue during use to form cracks and tear.

While any material which will perform adequately in the above fashion can be used, it is preferred to use a mixture of polypropylene and a proprietary material known as Santoprene from Advanced Elastomer Systems. While the particular materials contained in Santoprene are proprietary, it is believed that Santoprene is a mixture of polypropylene and butadiene rubbers. Polypropylene generally has sufficient flexibility, but a small amount of Santoprene when added to the polypropylene adds sufficient toughness so that the tongue 12 does not crack and rupture during use and also will have enough stiffness to remain horizontal when the mop is raised or as the mop is shaken to remove the dust. It is preferred to use approximately one part of Santoprene with between three to six parts of polypropylene by weight. The preferred Santoprene which can be used is known as Santoprene 203-50.

The exact shape and dimensions of tongue 12 can vary depending on the material used to mold tongue 12. Generally, it is thought for most materials that a tongue length between main frame 10 and handle socket 14 between 0.75" to 1.5" is preferred. The thickness of tongue 12 can be varied depending on the material used. It is preferred that tongue 12 be from 0.070 to 0.120" thick. The width of tongue 12 should be at least as wide as the socket connection an is not particularly critical.

Figure 7:
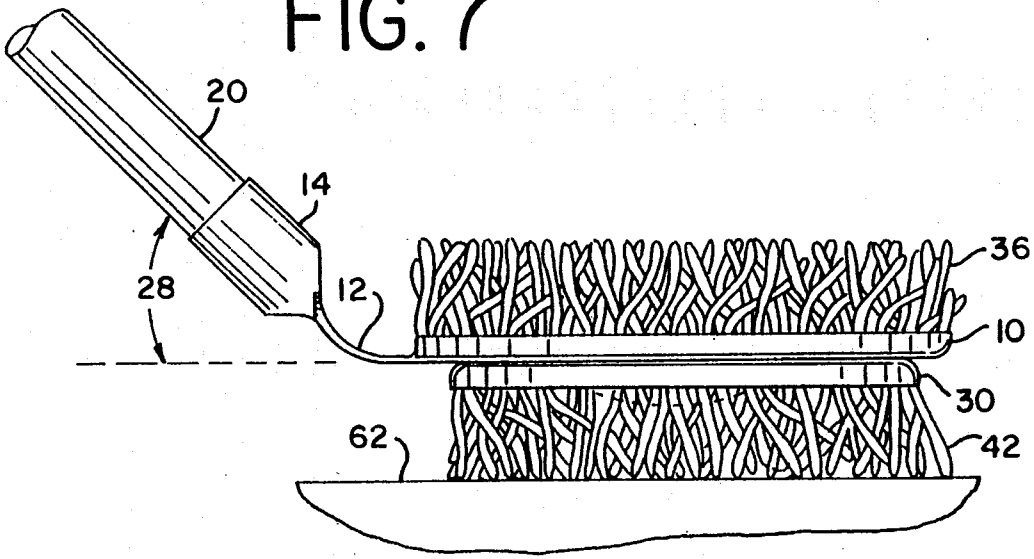
FIG. 7 is a diagrammatic side view of the dust mop in the ceiling-dusting position.

As shown diagrammatically in FIG. 7, if the user desires to use the dust mop to dust the ceiling, the user can contact the upper mop yarn strands 42 with ceiling 62 by inverting the dust mop and pressing the mop assembly against the ceiling. In this case, the tongue 12 flexes and forms a handle-tongue angle 28 which is approximately 30°–60° in the opposite direction from the at rest position.

Figure 8:
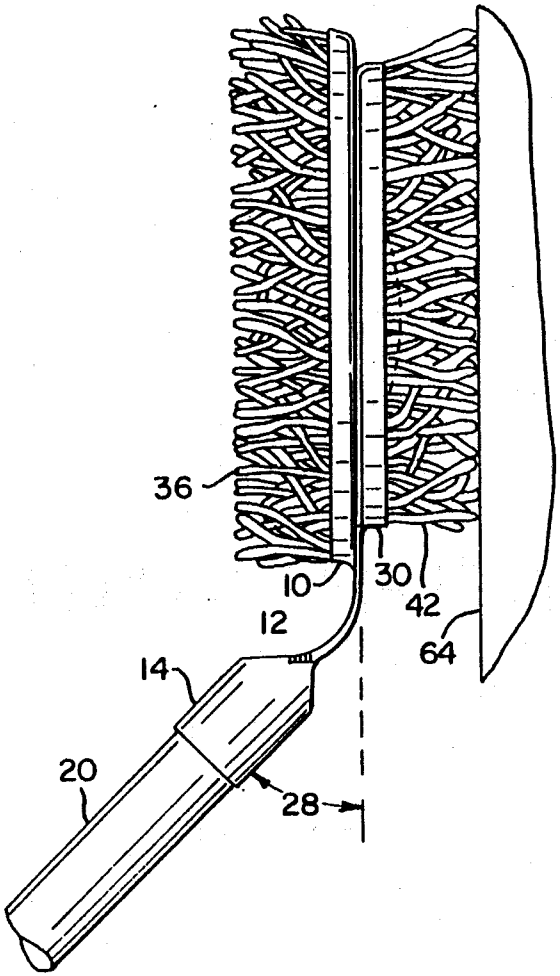
FIG. 8 is a diagrammatic side view of the mop in the wall-dusting position.

One advantage of the two sided dust mop of the present invention is that a clean dust mopping surface, upper mop yarn strands 42 can be used to contact the ceiling and the ceiling is not soiled by dust picked up from the floor by lower mop yarn strands 36. Generally, as shown diagrammatically in FIG. 8, the upper mop yarn strands 46 can also be used and contact a wall 64, again making a handle-tongue angle between the range of 30°–60° in the opposite direction from the at rest position.

INDUSTRIAL APPLICABILITY

The present invention relates to cleaning implements and cleaning tools, primarily for removing dust and other loose debris from surfaces.

What I claim is:

1. A dust mop for dusting a surface, said dust mop comprising:

a generally planar frame having opposing top and bottom surfaces;

mop yarn attached to at least one of said top and bottom surfaces;

a generally planar tongue having a first end and a second end, said first end being attached to and extending outwardly from a peripheral surface of said frame, said tongue being generally coplanar with said frame;

a handle socket attached to and extending from said tongue second end, said handle socket defining a central axis through and along a central portion thereof, said central axis and said tongue defining an acute angle therebetween, said tongue being dimensioned and constructed of a material which maintains the angular relationship between said handle socket and said frame in a nonuse condition, but which is adapted to flex under a pressure applied thereto by a user; and a handle having an end thereof received in said handle socket.

2. The dust mop of claim 1 wherein said mop yarn is attached to both of said top and bottom surfaces.

3. The dust mop of claim 1, wherein said frame, said tongue, and said handle socket are formed from a mixture of polypropylene and butadiene rubber to maintain said tongue and said frame at said acute angle with respect to said handle socket.

4. The dust mop of claim 1 wherein the weight of said mop yarn is between approximately 4 oz. and 9 oz.

5. The dust mop of claim 1, wherein said tongue has a length between approximately 0.95" and 1.30" and a thickness between approximately 0.90" and 0.105".

* * * * *